US005790982A

United States Patent [19]

Boutboul et al.

[11] Patent Number: 5,790,982

[45] Date of Patent: Aug. 11, 1998

[54] UNDERARM PERSPIRATION-ABSORBING GARMENT PAD

[76] Inventors: Ninette Boutboul, 125 Rue de la Resistance, Le Raincy, 93340, France; Inga Boutboul; Michel Boutboul, both of 210-174 St., Suite 1612, North Miami Beach, Fla. 33160

[21] Appl. No.: 739,783

[22] Filed: Oct. 30, 1996

[51] Int. Cl.[6] ..... A41D 27/12; A41D 27/13

[52] U.S. Cl. ..... 2/53

[58] Field of Search ..... 2/53, 54, 55, 56, 2/57, 267, 73, 125, 126, 105, 106; 450/81, 86; 604/385.1

[56] References Cited

U.S. PATENT DOCUMENTS

| | | | |
|---|---|---|---|
| 2,344,781 | 3/1944 | Mullen | 2/53 |
| 2,669,720 | 2/1954 | Vandekerck | 2/55 |
| 2,685,086 | 8/1954 | Henry | 2/55 |
| 2,818,572 | 1/1958 | Oliver | 2/55 |
| 3,077,603 | 2/1963 | Weaver | 2/55 |
| 3,346,878 | 10/1967 | Morris | 2/55 |
| 3,588,916 | 6/1971 | Glatt | 2/53 |
| 3,885,247 | 5/1975 | Kost | 2/55 |
| 4,545,080 | 10/1985 | Gorham | 2/56 |
| 4,747,162 | 5/1988 | Yanagihara | 2/53 |
| 4,856,111 | 8/1989 | Sholes | 2/56 |
| 5,038,409 | 8/1991 | Nager et al. | 2/56 |
| 5,042,088 | 8/1991 | Sherrod et al. | 2/56 |
| 5,103,500 | 4/1992 | Nager et al. | 2/56 |

*Primary Examiner*—Jeanette E. Chapman
*Attorney, Agent, or Firm*—Frank L. Kubler

[57] ABSTRACT

A garment pad for absorbing and shielding a garment from perspiration, the garment including a sleeve opening and a sleeve having a sleeve connection end and a sleeve connection seam at which the sleeve connection end is connected to the remainder of the garment around the sleeve opening, includes a pad body of absorbent material; and pad body attachment mechanism for securing the pad body across the lower portion of the sleeve connection seam adjacent to a garment wearer armpit. The pad body attachment mechanism preferably attaches the pad body to the garment removably. The pad body preferably includes a first pad face for directing toward the armpit of a garment wearer and a second pad face, and the attachment mechanism preferably includes an adhesive covering at least a part of the second pad face. The garment pad preferably additionally includes an adhesive backing sheet extending over and against the adhesive for shielding the adhesive until the pad is to be used, and for pealing away from the adhesive to expose the adhesive for making binding contact with the garment. The second pad face preferably includes two opposing end regions, where the adhesive covers only the two opposing end regions, and where two separate adhesive backing sheets respectively cover the end regions. The pad body is preferably ellipse-shaped to be rotatable to fit sleeves of various sizes.

10 Claims, 3 Drawing Sheets

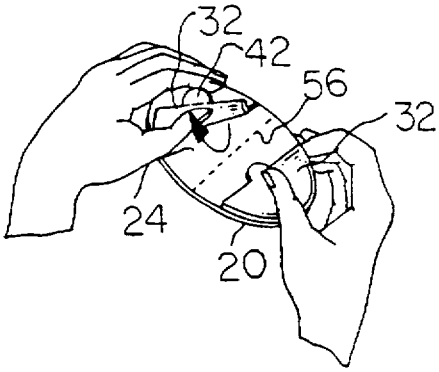
FIG. 4
FIG. 5
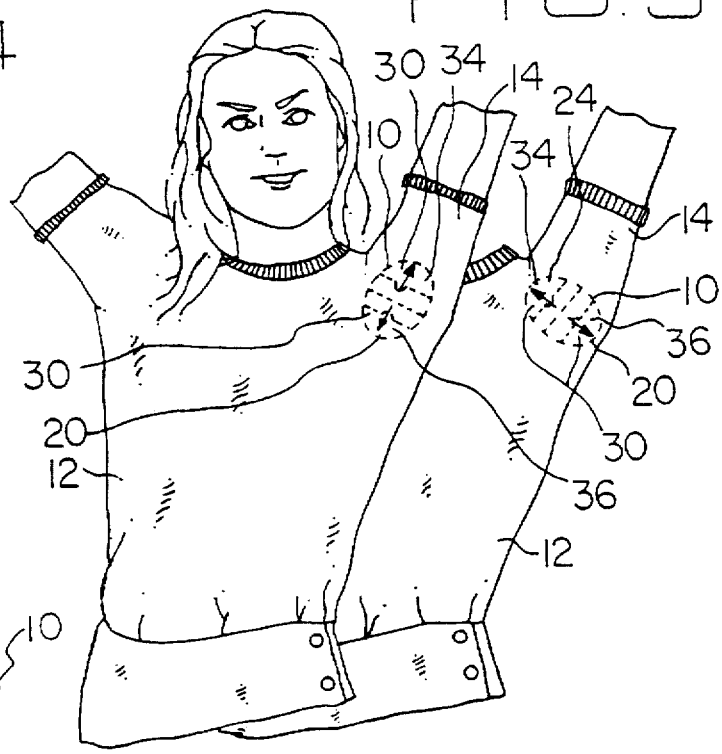
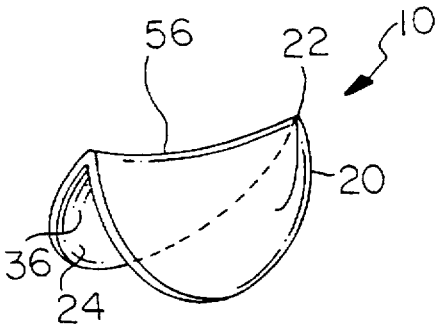
FIG. 9

UNDERARM PERSPIRATION-ABSORBING GARMENT PAD

FILING HISTORY

This application is based in part on the contents of disclosure document number 406463, filed on Oct. 1, 1996.

BACKGROUND OF THE INVENTION

1. Field of the Invention

The present invention relates generally to the field of clothing and clothing accessories. More specifically, the present invention relates to a pad made of absorbent material for removable securing inside a garment in the lower portion of the sleeve connection seam, such that the pad is positioned to fit adjacent to the armpit of a garment wearer. The pad protects the garment against perspiration damage and assures the wearer that perspiration does not soak through the garment and show underneath the sleeves. The pad includes pad body in the form of a substantially planar, flexible sheet having a first pad face which is directed toward the wearer armpit when the pad is installed, and a second pad face which is removably attached to the garment at the sleeve connection seam. The shape of the pad is preferably elliptical. The preferred removable attachment means is a conventional light adhesive which is not harmful to clothing. The adhesive is initially covered with a removable backing sheet.

2. Description of the Prior Art

There have been odor absorbing pads for feet which fit into shoes, one brand being known commercially as ODOR-EATERS™. A problem with the foot pads has been that their function is very limited, and no provision is made for shielding garments from the effects of perspiration under the arms.

It is thus an object of the present invention to provide a perspiration-absorbing pad which fits into a garment over the lower area of the connection seam of a sleeve directly adjacent to and making contact with the wearer armpit to shield and protect the garment from perspiration, and to prevent perspiration from showing through the garment.

It is another object of the present invention to provide such a pad which is attached to the garment removably, with attachment means which do not mar or otherwise damage the garment.

It is still another object of the present invention to provide such a pad for which one pad size fits garments having a variety of sleeve diameters.

It is finally an object of the present invention to provide such a pad which is relatively inexpensive to manufacture and therefore cost effective for frequent wearer use.

SUMMARY OF THE INVENTION

The present invention accomplishes the above-stated objectives, as well as others, as may be determined by a fair reading and interpretation of the entire specification.

A garment pad is provided for absorbing and shielding a garment from perspiration, where the garment includes a sleeve opening and a sleeve having a sleeve connection end and a sleeve connection seam at which the sleeve connection end is connected to the remainder of the garment around the sleeve opening, including a pad body of absorbent material; and pad body attachment mechanism for securing the pad body across the lower portion of the sleeve connection seam adjacent to a garment wearer armpit.

The pad body attachment mechanism preferably attaches the pad body to the garment removably. The pad body preferably includes a first pad face for directing toward the armpit of a garment wearer and a second pad face, and the attachment mechanism preferably includes an adhesive covering at least a part of the second pad face. The garment pad preferably additionally includes an adhesive backing sheet extending over and against the adhesive for shielding the adhesive until the pad is to be used, and for pealing away from the adhesive to expose the adhesive for making binding contact with the garment. The second pad face preferably includes two opposing end regions, where the adhesive covers only the two opposing end regions, and where two separate adhesive backing sheets respectively cover the end regions.

Each adhesive backing sheet optionally includes a pull tab directed toward the opposing adhesive backing sheet for the garment wearer to grip and pull the adhesive backing sheet away from the second pad face. The pad body is preferably divided into a pad arm portion and a pad chest portion by a pad hinge line of minimal bending resistance along which the pad body pivots when a garment wearer raises and lowers the wearer arm in the sleeve. The hinge line is optionally curved away from the garment wearer armpit to form a central pad body concave area for keeping the hinge line area of the folded pad body from rubbing against and irritating the wearer armpit area. The pad body is optionally scented to mask perspiration odor.

The pad body is preferably elongate such as ellipse-shaped for permitting the pad body to fit fully across the connection seam of the sleeve, where the sleeve has any diameter within a range of various diameters from relatively small to relatively large, to fit sleeves of various sizes, so that the ellipse minor axis fits fully across the armpit contact area of a sleeve connection seam of the relatively small diameter, and the ellipse major axis fits fully across the armpit contact area of a sleeve connection seam of the relatively large diameter, and so that the pad body fits fully across the armpit contact area of a sleeve connection seam having a diameter between the relatively small diameter and the relatively large diameter by orienting the pad body so that a suitable axis between the ellipse minor axis and the ellipse major axis extends across the armpit contact area of the given sleeve connection seam.

A method is provided of installing in the above-described elongate garment pad in a garment including a sleeve opening and a sleeve having a sleeve connection end and a sleeve connection seam at which the sleeve connection end is connected to the remainder of the garment around the sleeve opening, including the steps of orienting the pad body relative to the sleeve connection seam so that the pad body fits fully across the arm contact area of the connection seam; and securing the pad body with the attachment mechanism.

BRIEF DESCRIPTION OF THE DRAWINGS

Various other objects, advantages, and features of the invention will become apparent to those skilled in the art from the following discussion taken in conjunction with the following drawings, in which:

FIG. 4 is a perspective view of the pad of FIG. 3, showing a user pealing one of the backing sheets off the pad body.

FIG. 5 is a perspective view of the garment pad installed on two users in alternate orientations, the left pad orientation being suited to covering the armpit contact area of a smaller diameter sleeve and the right pad orientation being suited to covering the armpit contact area of a larger diameter sleeve.

FIG. 9 is a perspective view of the garment pad having the optional complex curve shape feature in which the hinge line area is curved concavely into the first pad face to minimize irritating contact with the user armpit.

DETAILED DESCRIPTION OF THE PREFERRED EMBODIMENTS

Figure 1:
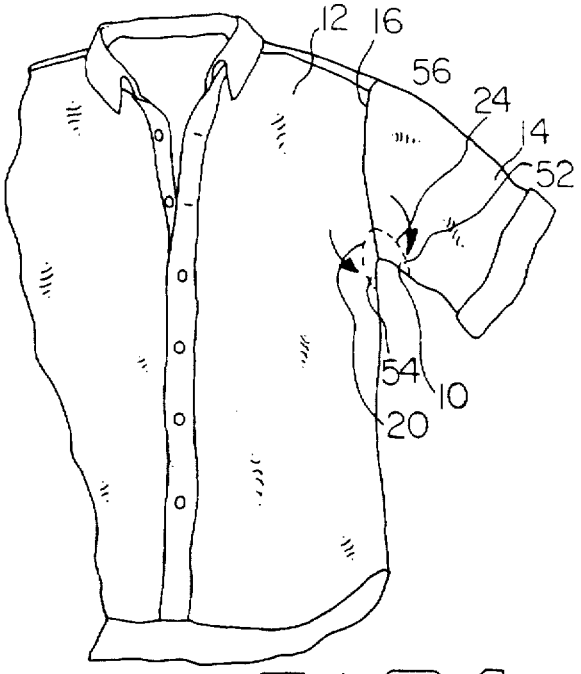
FIG. 1 is a partial, perspective front view of a shirt and one sleeve in a somewhat lowered position, the inside of the sleeve connection seam being fitted with the inventive garment pad at the armpit contact area, the garment pad being shown in broken lines.
Figure 2:
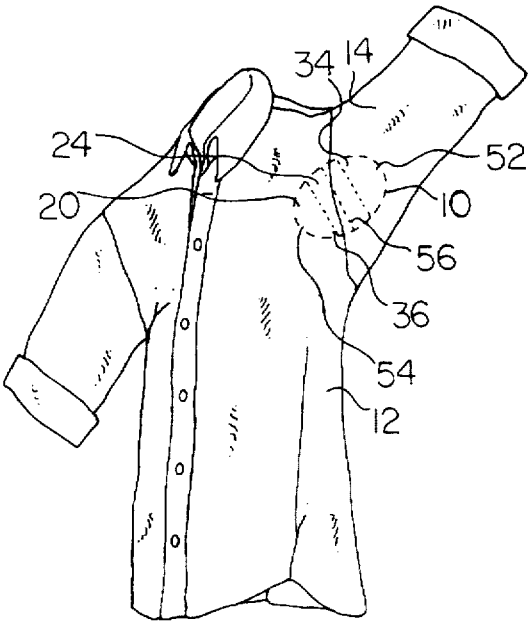
FIG. 2 is a partial, perspective side view of the shirt and sleeve of FIG. 1, with the raised position, once again revealing the garment pad in broken lines.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–9, a pad 10 made of absorbent material for removable securing inside a garment 12 over the lower area of the sleeve 14 connection seam 16, such that the pad 10 is positioned to be received in the armpit of a garment wearer, is disclosed. See FIGS. 1 and 2. Pad 10 protects the garment 12 against perspiration damage and assures the wearer that perspiration does not soak through the garment 12 and show underneath the sleeves 14. Pads 10 are disposable and intended to be worn only once, or for a very limited time.

Pad 10 includes pad body 20 in the form of a substantially planar sheet of absorbent material having a first pad face 22 which is directed toward the wearer armpit when the pad 10 is installed in the garment 12, and a second pad face 24 which is removably attached to the garment 12 at the lower portion of connection seam 16. The pad body 20 is preferably secured with removable attachment means in the form of a conventional light adhesive 30 which is not harmful to clothing. Adhesive 30 is spread over at least part of second pad face 24, and is initially covered with a plastic or paper adhesive backing sheet 32 which is removed when the pad 10 is to be used. See FIGS. 3 and 4. It is preferred that adhesive 30 be confined to opposing end regions 34 and 36 of second pad face 24, and that two separate adhesive backing sheets 32 cover respective end regions 34 and 36. Each adhesive backing sheet 32 preferably includes a pull tab 42 directed toward the opposing adhesive backing sheet 32 for the garment wearer to grip and pull the backing sheet 32 away from second pad face 24.

Pad 10 is preferably divided into a pad arm portion 52 and a pad chest portion 54 by a hinge line 56 in the form of a crease, perforation or line of reduced thickness. See FIGS. 1 and 3. Hinge line 56 permits the pad body 20 to bend evenly and with minimal resistance as the wearer arm is raised and lowered.

The pad body 20 shape is preferably elongate, and oval or ellipse-shapes are specifically preferred because they have continuously varying diameters, to permit pad body 20 to fit fully across the armpit contact area of connection seam 16 of sleeves 14 of various sizes. The pad body 20 is sized so that the ellipse minor axis just fits fully across the armpit contact area of the connection seam 14 of a smaller diameter sleeve 14, and the ellipse major axis just fits fully across the armpit contact area of the connection seam 16 of a larger diameter sleeve 14. Pad body 20 is oriented accordingly upon installation into the garment 12. See FIGS. 5–7. For sleeves 14 having diameters between the smaller and larger sizes, the elliptical shape permits the pad body 20 width across the seam 16 to be varied to match the armpit contact area width. This is accomplished by angling the pad body 20 across the armpit contact area by rotating the pad body 20 relative to the sleeve connection seam 16 until the width of the pad body 20 across the seam 16 matches the armpit contact area width. See FIG. 8.

Figure 3:
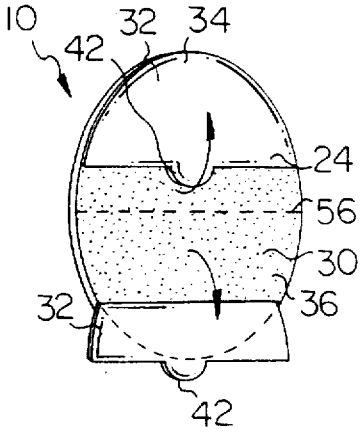
FIG. 3 is a close-up view of the garment pad alone, showing the second pad face and backing sheets with tabs covering the two opposing adhesive areas and with one of the backing sheets partially pealed away, and showing the preferred pad body hinge line.
Figure 6:
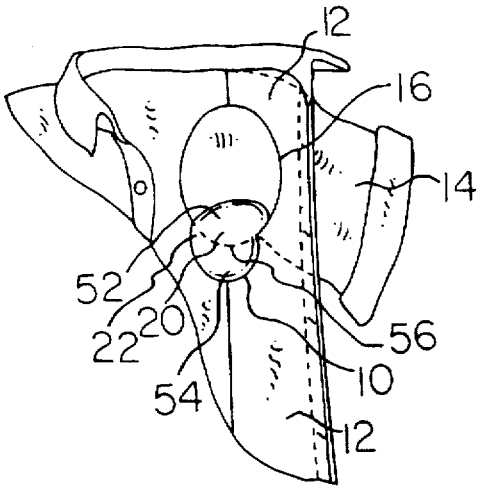
FIG. 6 is a partial, front perspective view of jacket fitted with the garment pad, the pad being oriented to cover the armpit contact area of a smaller diameter sleeve.
Figure 7:
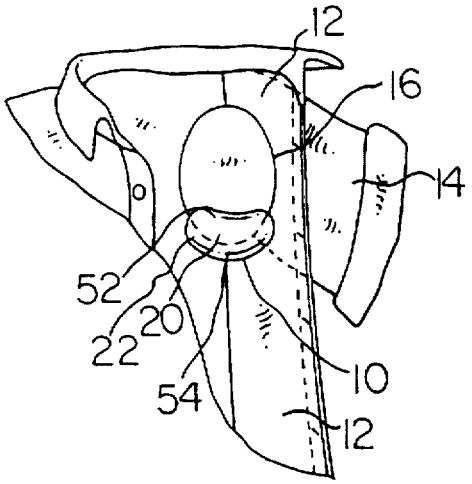
FIG. 7 is a partial, front perspective view of jacket fitted with the garment pad, the pad being oriented to cover the armpit contact area of a larger diameter sleeve.
Figure 8:
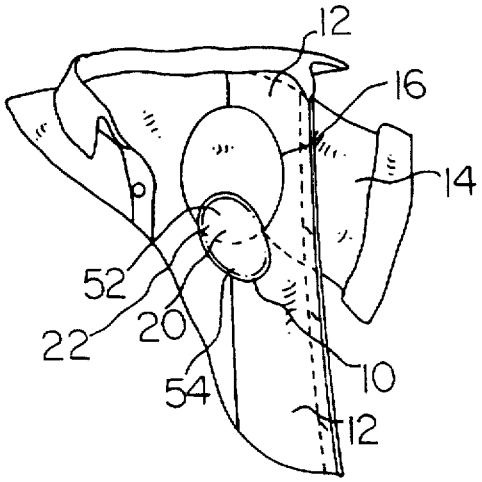
FIG. 8 is a partial, front perspective view of jacket fitted with the garment pad, the pad being oriented to cover the armpit contact area of a sleeve having a diameter between the smaller and larger sizes.

The pad body 20 may have a complex shape including a slight curve along the hinge line 56 recessing the first pad face 22 away from the user armpit area at the hinge line 56 for added wearer comfort. See FIG. 9. The hinge line 56 curve keeps the folded-over hinge line edge from rubbing against and irritating the wearer armpit area. The corners at the ends of the hinge line 56 are preferably rounded to be smooth against the user skin. Where the curve is complex, the rounding of these corners produces very small notches at the ends of hinge line 56, as shown in FIG. 3.

Various other pad body 20 shapes are contemplated, including but not limited to circular and square. These alternative shapes lack the adjustable width function of the preferred elliptical shape, however, and are therefore not equivalent.

The preferred absorbent material forming pad body 20 is the same used to manufacture the KOTEX™ LIGHT DAYS COMFORT DESIGN™ panty liners for monthly feminine hygiene, produced by KIMBERLY CLARK CORP. Other such products made from absorbent material suitable for pad body 20 include ALWAYS™ CONTOUR SOFT SORB pantiliners; and CAREFREE™ ULTRA DRY pantiliners produced by PERSONAL PRODUCTS COMPANY; and WALLGREENS™ panty liners.

Pad 10 is intended for use by both men and women. It may be provided in scented and unscented variations.

Method

In practicing the invention, the following method may be used. The method includes the steps of: orienting the pad body 20 relative to the sleeve connection seam 16 such that pad body 20 fits fully across the armpit contact area of the connection seam 16; and securing the pad body 20 with the attachment means over the sleeve connection seam 16.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A garment and pad apparatus, comprising:

a garment including a sleeve opening and a sleeve having a sleeve connection end and a sleeve connection line along which said sleeve connection end is connected to the remainder of said garment around said sleeve opening, said garment and sleeve defining an armpit contact area along said sleeve connection line, said armpit contact area having an armpit contact area width along said sleeve connection line;

a pad body including absorbent material for shielding said garment from perspiration, said pad body being substantially ellipse-shaped and having an ellipse minor axis which is shorter than said armpit contact area width at said sleeve connection line and having an ellipse major axis which is longer than said armpit contact area width at said sleeve connection line, and said pad body being oriented relative to said sleeve connection line such that an axis between said ellipse minor axis and said ellipse major axis having a length substantially matching said armpit contact area width extends across said armpit contact area width at said sleeve connection line;

and pad body attachment means securing said pad body to said garment.

2. The apparatus of claim 1, wherein said pad body attachment means attaches said pad body to said garment removably.

3. The apparatus of claim 1, wherein said pad body comprises a first pad face for directing toward the armpit of a garment wearer and a second pad face, and wherein said attachment means comprises an adhesive covering at least a part of said second pad face.

4. The apparatus of claim 3, additionally comprising an adhesive backing sheet extending over and against said adhesive for shielding said adhesive until said pad is to be used, and for pealing away from said adhesive to expose said adhesive for making binding contact with said garment.

5. The apparatus of claim 4, wherein said second pad face comprises two opposing end regions, wherein said adhesive covers only said two opposing end regions, and wherein two separate adhesive backing sheets respectively cover said end regions.

6. The apparatus of claim 5, wherein each said adhesive backing sheet comprises a pull tab directed toward the opposing said adhesive backing sheet for the garment wearer to grip and pull the adhesive backing sheet away from said second pad face.

7. The apparatus of claim 1, wherein said pad body is divided into a pad arm portion and a pad chest portion by a pad hinge line extending substantially parallel to said sleeve connection line and being of minimal bending resistance such that said pad body pivots along said pad hinge line when a garment wearer raises and lowers the wearer arm in said sleeve.

8. The apparatus of claim 7, wherein said hinge line is curved away from the garment wearer armpit to form a central pad body concave area for keeping the hinge line area of the folded pad body from rubbing against and irritating the wearer armpit area.

9. The apparatus of claim 1, wherein said pad body is scented to mask perspiration odor.

10. A method of installing in a garment including a sleeve opening and a sleeve having a sleeve connection end and a sleeve connection line at which said sleeve connection end is connected to the remainder of said garment around said sleeve opening a garment pad comprising a pad body of absorbent material and pad body attachment means for securing said pad body across the lower portion of said sleeve connection seam adjacent to a garment wearer armpit, wherein said pad body is substantially ellipse-shaped for permitting said pad body to fit fully across said connection seam of said sleeve, wherein said sleeve has any diameter within a range of various diameters for relatively small to relatively large, to fit sleeves of various sizes, such that the ellipse minor axis fits fully across the armpit contact area of a sleeve connection seam of said relatively small diameter, and the ellipse major axis fits fully across the armpit contact area of a sleeve connection seam of said relatively large diameter, and such that said pad body fits fully across the armpit contact area of a sleeve connection seam having a diameter between said relatively small diameter and said relatively large diameter by orienting said pad body such that a suitable axis between said ellipse minor axis and said ellipse major axis extends across the armpit contact area of the given sleeve connection seam, comprising the steps of:

orienting said pad body relative to said sleeve connection line by positioning a pad body axis between said ellipse minor axis and said ellipse major axis to a length substantially matching the width of said armpit contact area such that said pad body axis extends fully across the armpit contact area at said connection line;

and securing said pad body with said attachment means.

* * * * *